US005360255A

United States Patent [19]

Cook et al.

[11] Patent Number: 5,360,255

[45] Date of Patent: Nov. 1, 1994

[54] THREE-WAY FRAME INCLINER

[75] Inventors: Robert E. Cook, New Albany; Charles J. Tidwell, Jr.; Donald Shutiok, both of Tupelo; William Tacker, Smithville; Gregory M. Lawson, Tupelo; Terry Johnson, Mantachie, all of Miss.

[73] Assignee: Super Sagless Corporation, Tupelo, Miss.

[21] Appl. No.: 694,147

[22] Filed: May 1, 1991

Related U.S. Application Data

[63] Continuation-in-part of Ser. No. 333,590, Apr. 4, 1989, abandoned, which is a continuation-in-part of Ser. No. 60,099, Jun. 9, 1987, abandoned.

[51] Int. Cl.[5] ..... A47C 1/035

[52] U.S. Cl. ..... 297/232; 297/68; 297/85

[58] Field of Search ..... 297/68, 85, 232, 460

[56] References Cited

U.S. PATENT DOCUMENTS

| | | | |
|---|---|---|---|
| 3,893,729 | 7/1975 | Sherman et al. | 297/232 X |
| 4,337,977 | 7/1982 | Rogers, Jr. et al. | 297/85 |
| 4,904,019 | 2/1990 | May | 297/68 X |
| 4,989,914 | 2/1991 | Pine | 297/232 X |
| 5,064,244 | 11/1991 | Spreule | 297/68 |
| 5,106,153 | 4/1992 | Durling | 297/232 |

*Primary Examiner*—Peter R. Brown

*Attorney, Agent, or Firm*—Wolf, Greenfield & Sacks

[57] ABSTRACT

A modular furniture seating section having a pair of side rails that define a base for the section and a pair of reclining mechanisms, one mounted on each of the side rails. Each of the mechanisms includes a seat mounting link which together carry a seat frame that in turn carries the seat of the chair. An ottoman linkage is mounted on the front of the seat mounting link in each mechanism and together they carry the ottoman which moves between retracted and extended positions. The mechanisms also include a backrest linkage which carries the backrest frame that, in turn, carries the backrest. On one side only of the chair an arm panel is secured to the seat frame and moves together with the seat in fixed relationship thereto as the chair moves between upright and reclined positions. On the same side as the arm panel, a backrest side wing is mounted on the backrest frame so as to move with it. The arm panel and backrest wing are disposed on the side of the chair section which forms an end of a modular furniture grouping.

17 Claims, 14 Drawing Sheets

THREE-WAY FRAME INCLINER

RELATED APPLICATIONS

This application is a continuation-in-part of application Ser. No. 07/333,590 filed Apr. 4, 1989, which in turn is a continuation of application Ser. No. 07/060,099 filed Jun. 9, 1987, now abandoned. This application is also related to U.S. Pat. No. 4,805,960 dated Feb. 21, 1989. All of these related applications are assigned to the same entity as the assignee of the present application.

INTRODUCTION

This invention relates to modular furniture having reclining chair sections and more particularly to the mechanisms and frames used in the reclining chair sections of the modular furniture.

Customarily, in the manufacture of sofas with reclining chair sections integrated into a single frame, "frame within a frame" construction is employed wherein the reclining section is enclosed in a stationary back and armrest frame that is built into the one-piece sofa unit and an incliner mechanism is employed mounted directly on the frame. Special "frame within a frame" mechanisms are used for this purpose. On the other hand, in modular furniture having a separate reclining seat section, customarily a three-way recliner mechanism is used that has its own metal base which rests on the floor. In this latter arrangement, no separate stationary frame is employed, and the armrest is attached to the seat and moves with it. The three-way recliner mechanisms cost approximately 25% more than the incliner mechanisms.

The present invention employs "frame within a frame"-type mechanisms without a fixed outside frame, and the outside arm is attached to and moves with the seat as the chair section moves from upright to TV and fully reclined positions as in the three-way recliners to achieve substantial manufacturing costs savings and an improved product. The invention is suitable for use in modular furniture wherein the reclining section is either permanently attached to a fixed seating section or is a separate, detached unit. The versatility of the mechanism in modular furniture with an integrated arm and seat enables the furniture manufacturer to reduce its inventory of different types of mechanisms and results in additional savings.

In U.S. Pat. No. 4,805,960 and in copending application Ser. No. 07/060,099 supra, mechanisms are shown which were developed for use in incliner or "frame within a frame" chairs. As suggested above, frame within a frame reclining chairs include fixed arms and a back that remain stationary on the floor and provide the main support for the chairs. The mechanisms which support the movable seat and backrest of the chair are mounted on the insides of the fixed arms and do not include a separate metal base. As the chairs are moved to the TV or fully reclined positions from the upright position, the fixed arms and back of the chair do not move. In accordance with the present invention, the same or a similar type mechanism is incorporated into the reclining chair section in modular furniture with the outside arm connected to and movable with the seat between upright and reclined positions. The metal base normally employed in such constructions is eliminated and the mechanisms are mounted directly on the frame off the floor. The mechanisms and the manner in which the outside arm is mounted on the seat provide a substantially stronger and more rigid structure than is achieved in prior art arrangements.

The mechanisms of the present invention are mounted on wood side base rails that rest on the floor, and as indicated, no metal mechanism base is employed. The base rails support the entire reclining chair section of the modular furniture, and the wood rails provide a convenient support for optional leg arrangements. Metal tubes extend across the chair section beneath the seat and carry brackets at their ends which correspond to the end of the modular furniture arrangement. The brackets in turn carry the arm which moves with the seat between the upright and reclined positions. A backrest wing is connected to the back of the chair essentially in the plane of the armrest but moves in fixed relationship to the backrest rather than the seat. There is, of course, no armrest or wing on the other side of the chair section which lies against another section of the modular furniture. The metal tubes not only provide very strong and rigid supports for the armrest but in addition may be used for attaching the seat springs. This arrangement may eliminate the need for conventional wood or metal seat cross members.

The invention will be better understood and appreciated from the following detailed description of two embodiments thereof, selected for purposes of illustration and shown in the accompanying drawings.

DETAILED DESCRIPTION

Figure 1:
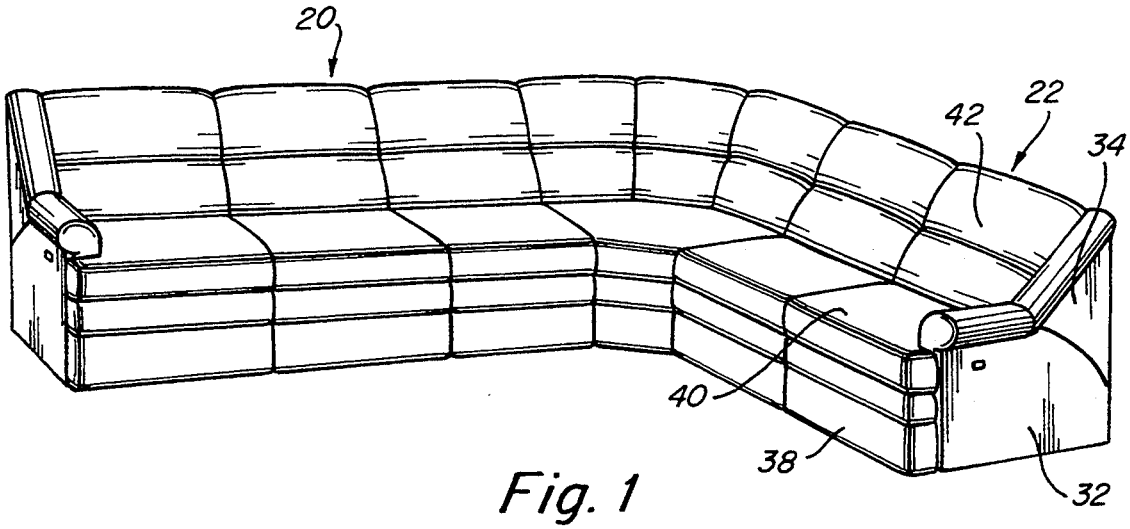
FIG 1 is a perspective view of a modular seating arrangement including sofa and reclining chair sections with the chair section in the upright position.
Figure 2:
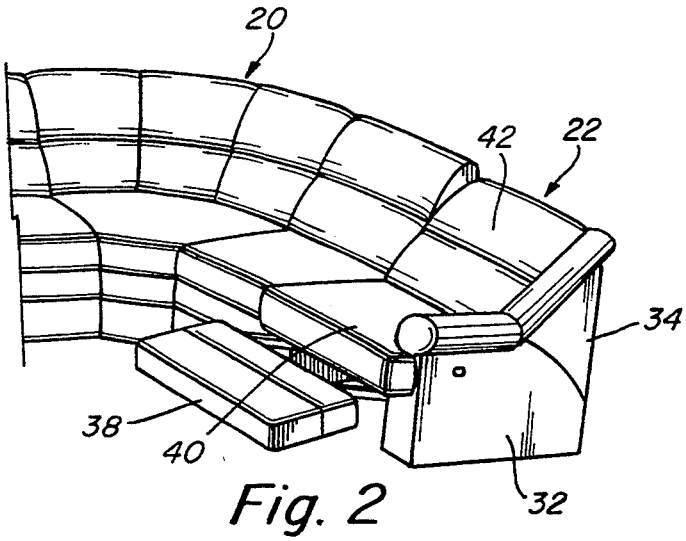
FIG. 2 is a fragmentary view of the chair and sofa sections shown in FIG. 1, but with the chair in the TV or intermediate position.
Figure 3:
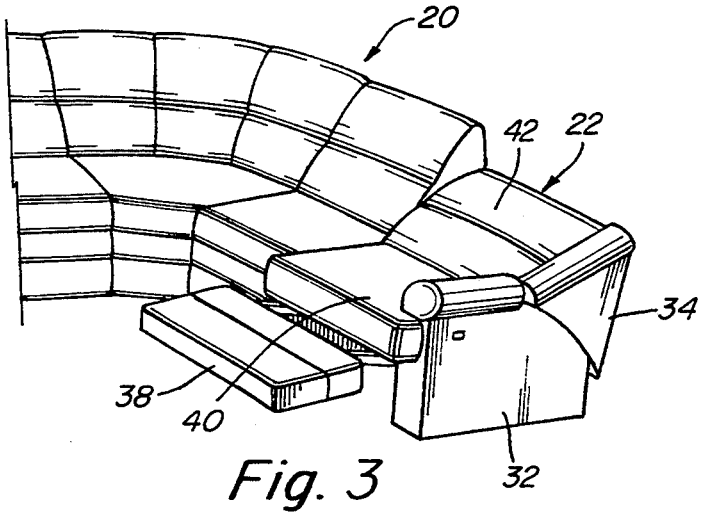
FIG. 3 is a fragmentary perspective view similar to FIG. 2, but showing the chair section in the fully reclined position.

In FIG. 1, a modular seating arrangement is shown composed of a sofa 20 and reclining chair 22 disposed side by side so that the two sections of the modular furniture appear as a single continuous unit when the chair is in the upright position. That is, the seats, backrests and frames of the sections are matched so that they have the appearance of one large sofa. The reclining chair 22 that comprises one of the furniture sections may, however, be movable with respect to the sofa section and be independently constructed relative thereto, and it can be oriented in an upright position as shown in FIG. 1 and one or more reclining positions, namely an intermediate or TV position and a fully reclined position as suggested in FIGS. 2 and 3, respectively. The present invention is described in terms of its application in the reclining chair section 22. In the two embodiments of the invention described below, the frame construction of the chair section is essentially the same, but different reclining chair mechanisms are employed in the different embodiments.

In FIGS. 4–10, one embodiment of the invention is shown in detail employing a reclining mechanism composed wholly of links and pivots and free of any tracks and rollers. (In the embodiment of FIGS. 11–15, the mechanism includes tracks and rollers as well as links and pivots.)

Figure 4:
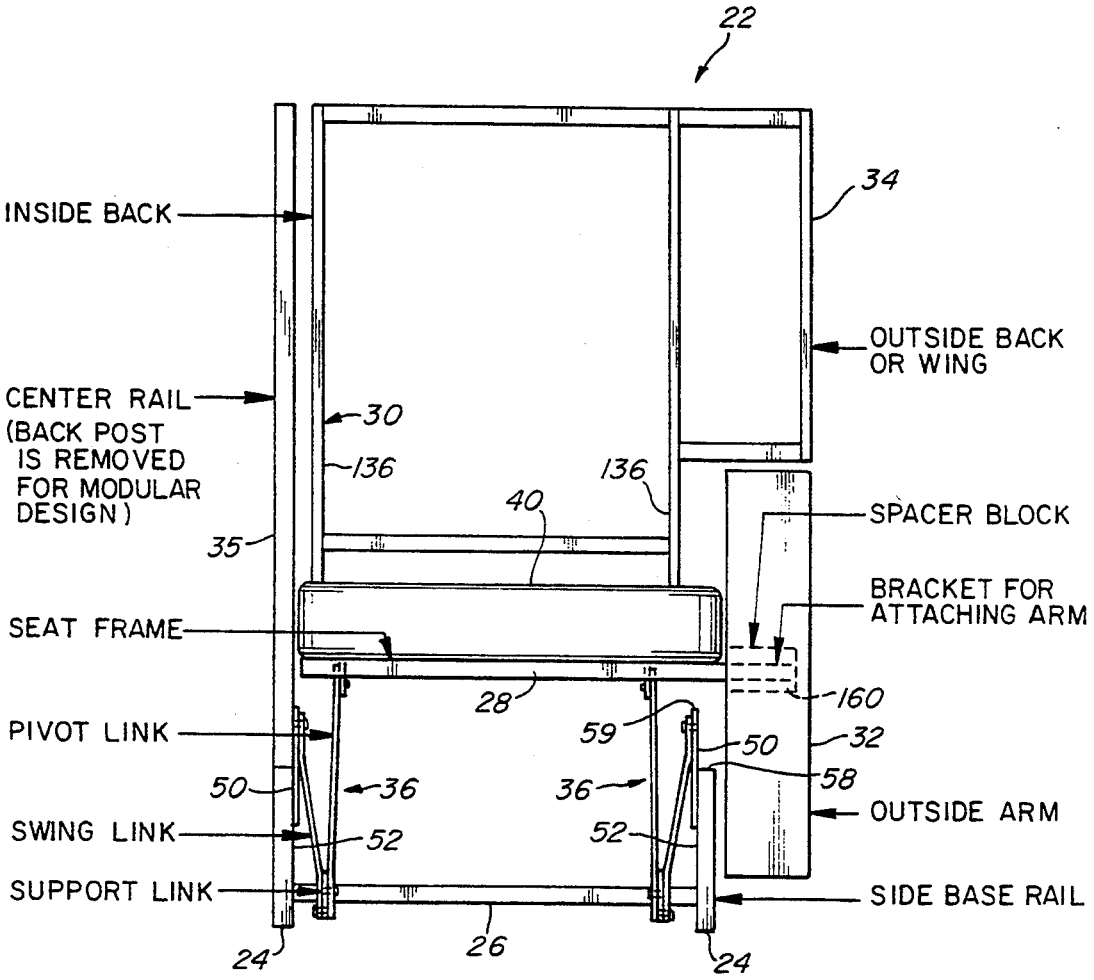
FIG. 4 is a front elevation view of the chair with the upholstery stripped away and the frame and mechanisms shown diagrammatically so as to illustrate the relationship of the several parts.

In FIGS. 4–7, portions of the wood frame of the modular chair are shown. The chair frame includes a pair of side base rails 24 connected together by cross rails 26. The base rails together form a base for the chair section. The base rail 24 on the side of the chair section adjacent the sofa section may be an integral part of the sofa frame or alternatively it may be separate from the sofa frame and simply abut against it when the modular sections are placed together. The chair frame also includes a seat frame 28, back frame 30, a single outside arm panel 32 and an outside back wing 34. The panel 32 and the wing 34 are disposed on the same side of the chair section and are located at the end of the modular furniture arrangement. No arm panel or wing is provided on the other side of the chair section. Rather, on the other side of the frame, a center rail 35 may be provided as shown in FIG. 4 which is in the plane of the base rail 24 on that side and may be integrally formed with it. The center rail like the base rail may be part of the sofa frame when the two sections are integral with one another. If the sections are separable, center rail 35 abuts against the adjacent end of the sofa when the chair and sofa sections 22 and 20 are positioned together as in FIG. 1, and they may or may not be bolted together. The various parts of the chair frame are connected together by the reclining chair mechanism 36 which is shown in detail in FIGS. 5–10.

Figure 5:
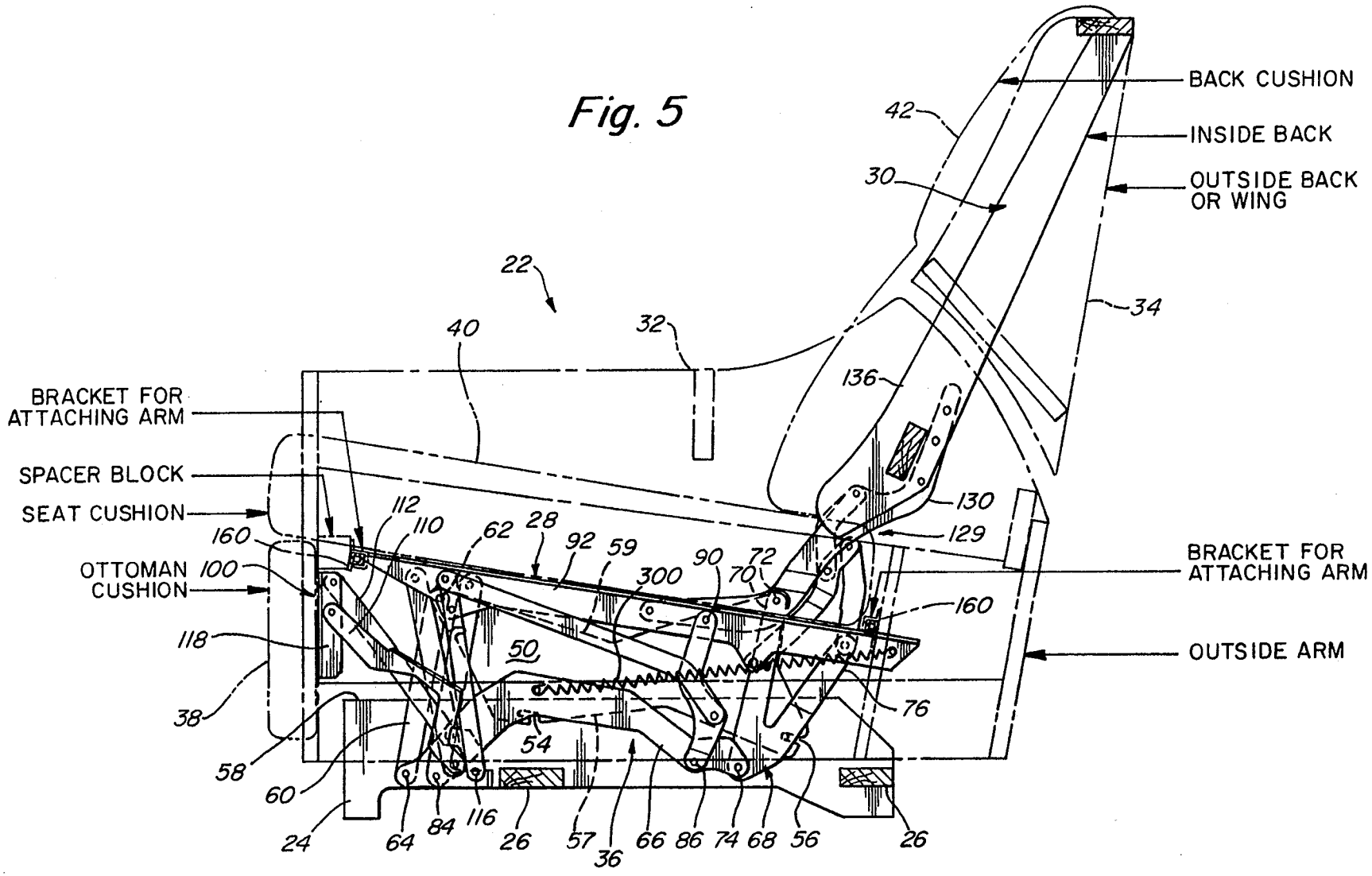
FIG. 5 is a diagrammatic view of the chair section of FIGS. 1–4 and showing the details of the linkage mechanism on one side thereof with the chair section in the upright position and further showing in broken lines the seat and back cushions.

In FIG. 5, the modular reclining chair section 22 is shown in the upright position with the ottoman 38 retracted beneath the front edge of the seat 40. The back 42 is raised to a position wherein it is disposed approximately perpendicular to the seat. The mechanism 36 is one of two essentially identical mechanisms disposed on each side of the modular reclining chair section. (The two are mirror images of one another.) Because the mechanisms are essentially identical, only one is shown and described.

The mechanism 36 is secured to the base rail 24 by the mounting plate 50 which in this embodiment is a relatively large vertical steel plate fastened to the inner face 52 of the base rail 24. The mounting plate 50 is secured to the base rail 24 by means of screws or other fasteners that engage slots 54 and 56 adjacent the lower edge 57 of plate 50. The upper edge 59 of the plate 50 is disposed above the upper surface 58 of the base rail.

A front swing link 60 is secured by pivot rivet 62 to the front upper corner of mounting plate 50 (see FIG. 6) and extends downwardly therefrom in a forwardly direction toward the front of the chair. The lower end of the swing link 60 is connected by rivet pivot 64 to the front end of a support link 66, and the rear portion of the support link is carried by a rear V-shaped swing link 68 having a front arm 70 carried by a pivot rivet 72 on the upper rear corner of the mounting plate 50. The rear swing link 68 is secured by pivot rivet 74 to the rear end of the support link 66. The other arm 76 of the rear swing link 68 is described below in connection with the operation of the backrest support linkage.

The support link 66 carries front and rear upwardly extending pivot links 80 and 82 connected to it by rivet pivots 84 and 86, respectively. The upper ends of the pivot links 80 and 82 are connected by pivot rivets 88 and 90 to the seat mounting link 92 which in turn carries the seat frame 28.

It will be appreciated that the mechanism thus far described is essentially composed of two four-bar linkage systems, the first comprised of the mounting plate 50, front and rear swing links 60 and 68, and the support link 66 and the second comprised of the support link 66, pivot links 80 and 82, and the seat mounting link 92. When the chair moves from the upright to the TV position, that is, from the position shown in FIG. 5 to that shown in FIG. 6, the swing links 60 and 68 and the support link 66 remain essentially stationary with respect to the base rail 24 suspended from the mounting plate 50. The pivot links 80 and 82, on the other hand, move forwardly (pivot counterclockwise as viewed in FIGS. 5 and 6) to, in turn, move the mounting plate forwardly and somewhat downwardly from the upright position. When the chair moves from the TV position of FIG. 6 to the fully reclined position of FIG. 7, the pivot links 80 and 82 remain fixed with respect to the support link 66, but the support link 66 moves forwardly and somewhat upwardly as the swing links 60 and 68 pivot in a clockwise direction about their pivot rivets 62 and 72 on the mounting plate 50. Thus, two separate pivotal actions are imparted when the chair moves from the upright position of FIG. 5 to the fully reclined position of FIG. 7.

The mechanism 36 includes an ottoman linkage 100 which is a generally conventional, lazy tong linkage composed of a first pair of ottoman links 102 and 104 pivotally connected by rivets 106 and 108 to the front end of the seat mounting link 92 and a second pair of ottoman links 110 and 112, in turn, pivotally connected by rivets 114 and 116 to the free ends of the first pair of ottoman links 102 and 104. The other ends of the second pair of ottoman links 110 and 112 are pivotally connected to the ottoman bracket 118 which carries ottoman 38. The lazy tong linkage is completed by a pivot 120 which pivotally joins the links 102 and 112 intermediate their ends.

Figure 6:
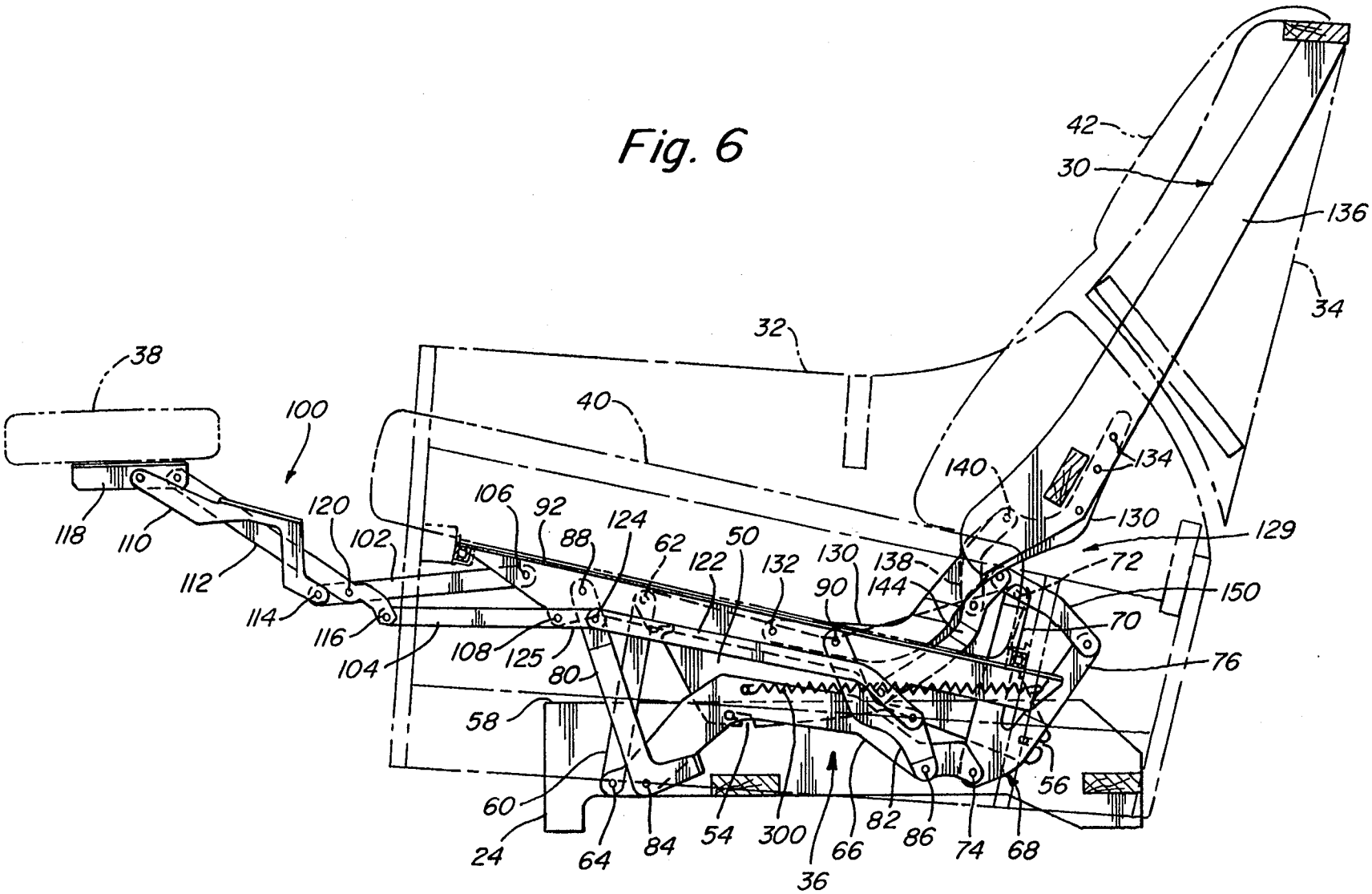
FIG. 6 is a view similar to FIG. 5 with the chair section in the TV position.
Figure 7:
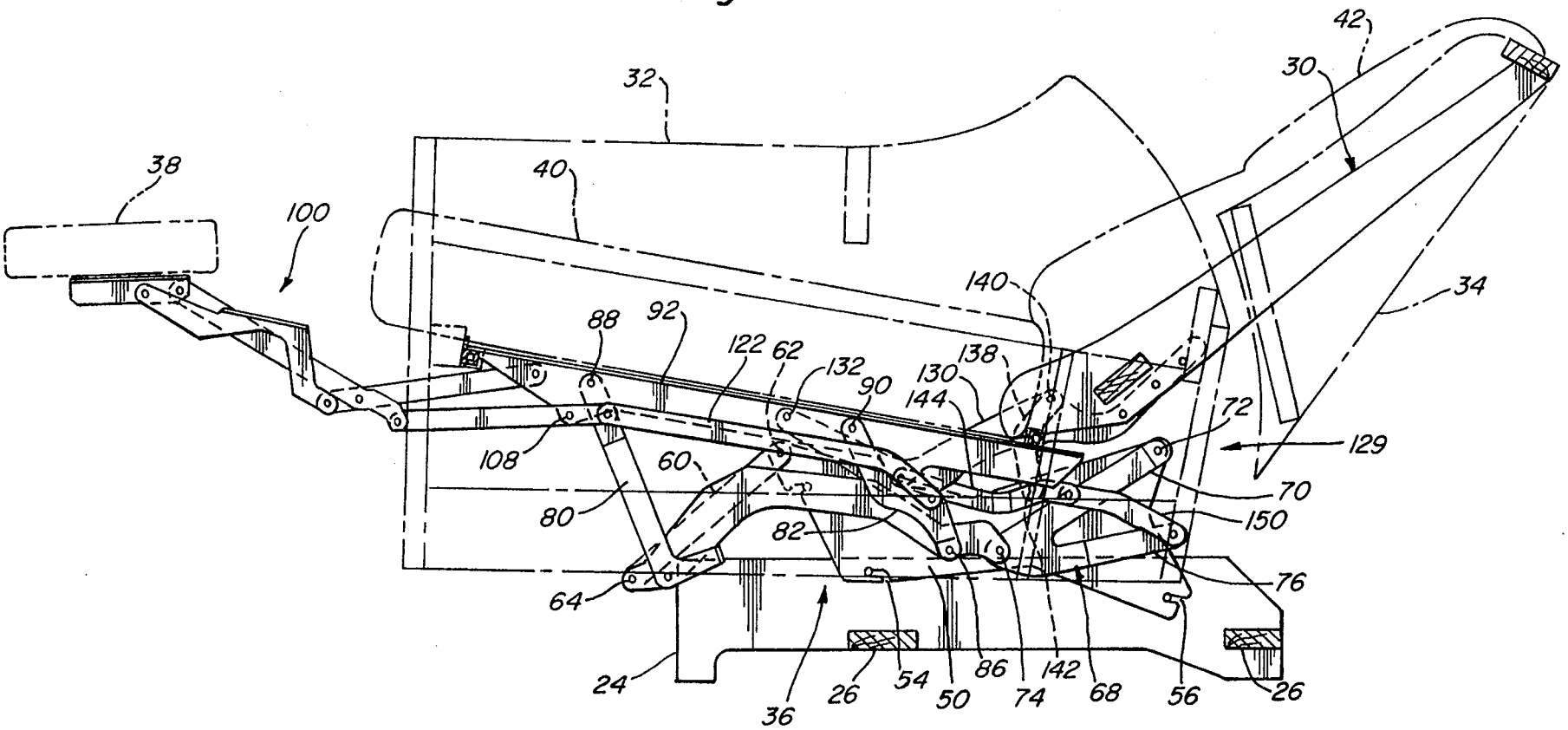
FIG. 7 is a view similar to FIGS. 5 and 6, but showing the chair section in the fully reclined position.

The ottoman linkage is moved from the closed position of FIG. 5 to the open position of FIGS. 6 and 7 by the ottoman drive link 122 which is pivotally connected by rivet 124 to the end 125 of the ottoman link 104 beyond pivot 108. The other end of the drive link 122 is connected to the rear pivot link 82 by rivet 126. When the chair moves from the upright to the TV position, the pivotal action of the pivot link 82 in a counterclockwise direction about its pivot 86, as viewed in the drawings, moves the seat link 92 in a forward direction and the pivot 108 of ottoman link 104 with it in the same direction, away from the rear pivot link 82. This action causes the ottoman drive link 122 to pull the top end of ottoman link 104 rearwardly and rotates it in a clockwise direction on pivot 108 so as to elevate the footrest 38. Because no additional relative motion occurs between the seat mounting link 92 and the rear pivot link 82 when the chair moves from the TV to the fully reclined position, the ottoman drive link 122 does not impart any additional motion to the lazy tong linkage relative to the seat during that transition. Therefore, the ottoman 38 remains elevated in essentially the same position with respect to the seat when the chair moves from the TV to fully reclined position.

Figure 8:
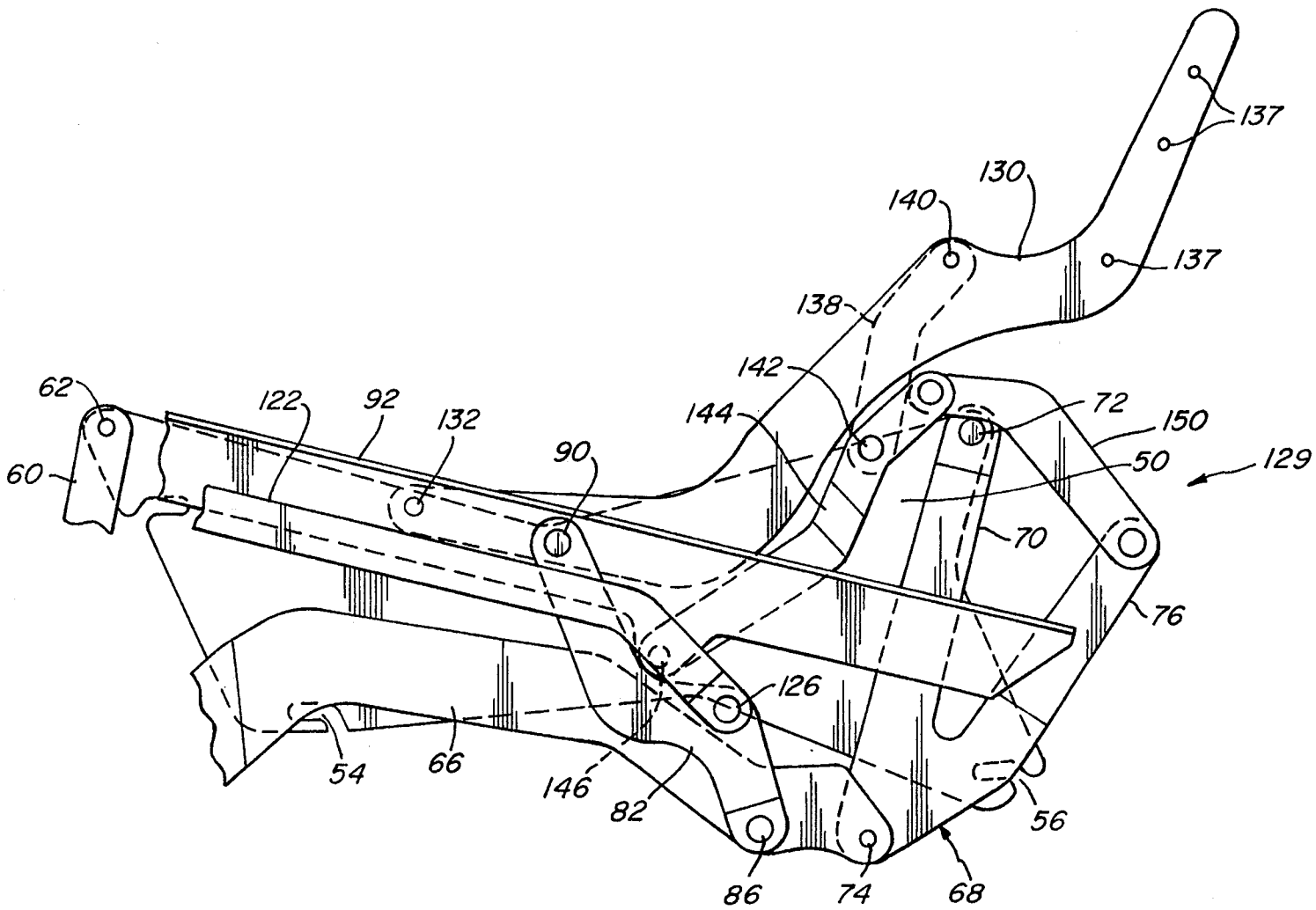
FIG. 8 is a detailed view of the backrest supporting linkage of the mechanism shown in FIGS. 5–7 with the backrest in the TV position.
Figure 9:
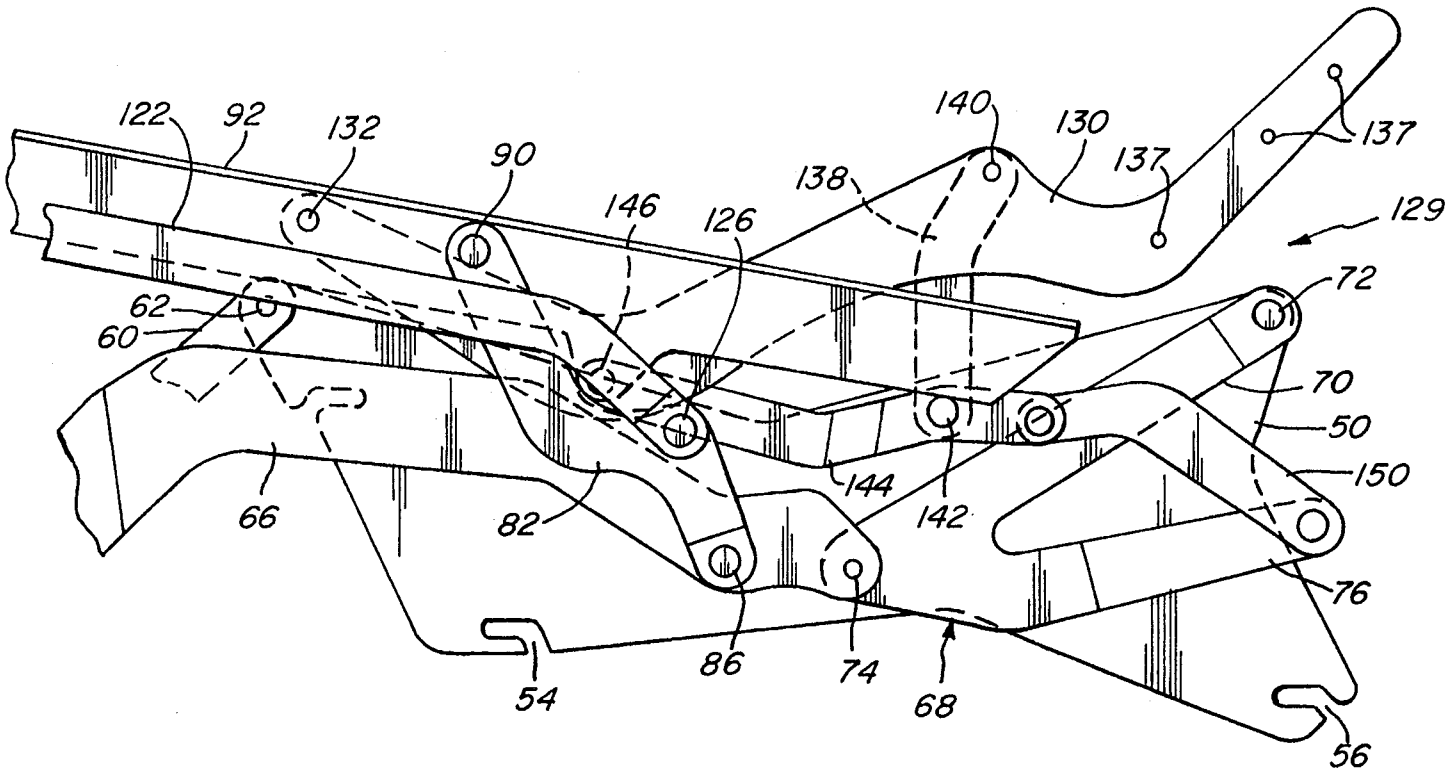
FIG. 9 is a view similar to FIG. 8 but showing the backrest linkage in the fully reclined position.

The backrest frame 30 is pivotally connected to the seat mounting link 92 by backrest mounting linkage 129 shown in detail in FIGS. 8 and 9. The linkage 129 includes mounting link 130 pivoted at its lower forward end by pivot rivet 132 to the seat mounting link 92. The upper end of the mounting link 130 is secured by a number of rivets or other fasteners 134 to the side rail 136 of the back frame 30. (Note holes 137 for that purpose in FIGS. 8 and 9.) Thus, the backrest carried by the backrest frame 30 is fixed to and moves with the mounting link 130 about the pivot 132 secured to the seat mounting link.

A first backrest control link 138 is pivotally secured to the mounting link 130 by pivot rivet 140, and the other end of the control link 138 is connected by pivot rivet 142 to a backrest support link 144. The lower end of the support link 144, in turn, is secured by rivet 146 to the seat mounting link 92. Thus, mounting link 130, first backrest control link 138, backrest support link 144 and seat mounting link 92 together define a four-bar linkage which enables the backrest to move between the upright position of FIG. 5 to the fully reclined position of FIGS. 7 and 9. (No relative motion occurs between the backrest and seat when the chair moves from the upright to the TV position and no motion occurs in the four-bar linkage. Therefore, the four-bar linkage shown in FIG. 8 and identified as the TV position is the same as the upright position of FIG. 5.) The movement of the backrest relative to the seat is governed by the second control link 150 that is connected at one end to the upper end of the second arm 76 of swing link 68 and at its other end to the support link 144. When the chair section is in the TV position and the occupant applies a rearwardly directed force against the backrest, the four-bar linkage allows the backrest to pivot rearwardly about the pivot 132, and that action causes the support link 144 to pivot clockwise as viewed in FIGS. 6 and 8, which in turn causes the control link 150 to push rearwardly against the top of second arm 76 of rear swing link 68. As a result, swing link 68 pivots clockwise about pivot 72 on the support plate 50 as does the front swing link 60 causing the support link 66 to move forwardly with respect to the base rail 24 and move the pivot links 80 and 82 along with seat mounting link 92 and seat 40 in a forwardly and upwardly direction. In this manner, the chair assumes the fully reclined position.

In FIGS. 5 and 6, a spring 300 is shown connected between the rear end of the seat mounting link 92 and the support link 66. The spring acts in tension to urge the seat mounting link 92 in a forward direction with respect to the carrier link, that is, the spring urges the front and rear pivot links 80 and 82 to pivot counterclockwise as viewed in those figures and move the seat mounting link to the intermediate position. That action is restrained by the mechanism shown in FIG. 10.

Figure 10:
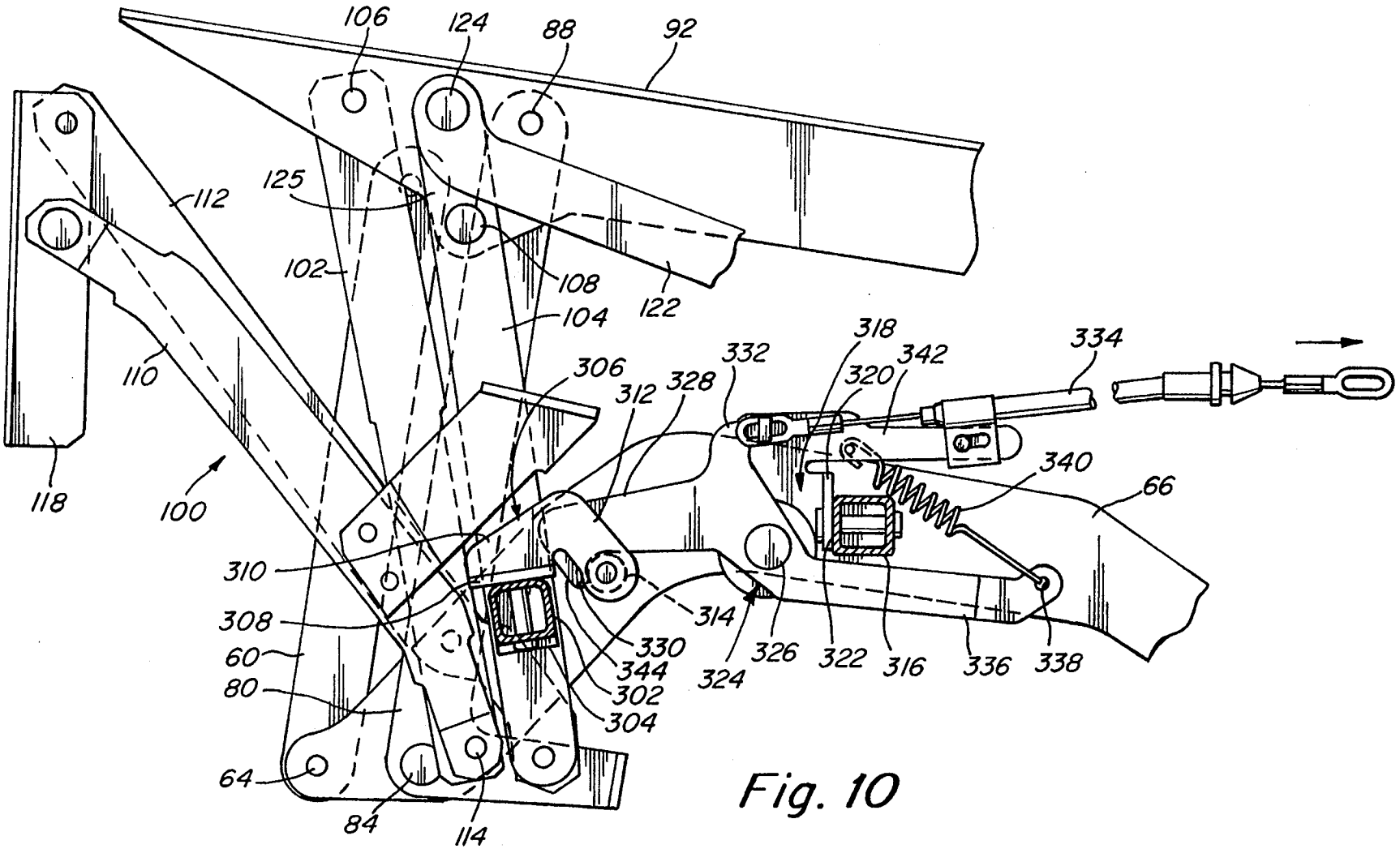
FIG. 10 is a detailed view of a portion of the chair mechanism of FIGS. 5–7 and showing the latching assembly for retaining the chair section in the upright position of FIG. 5.
Figure 11:
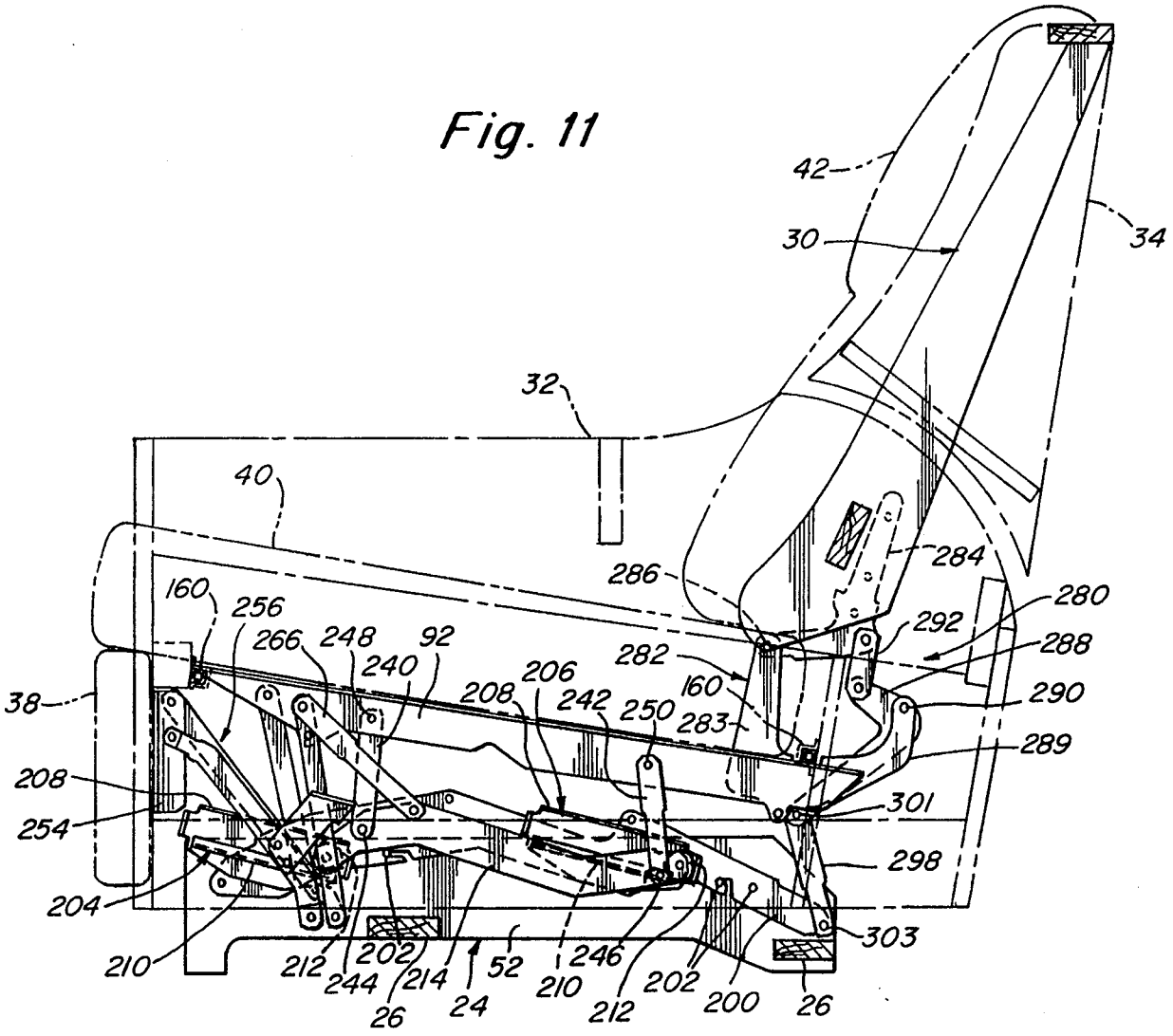
FIG. 11 is a side view similar to FIG. 5, but showing a second embodiment of a modular chair section and employing a different mechanism from that in FIGS. 5–7.

In FIG. 10, a cross tube 302 is shown mounted on the ottoman link 104. That tube extends across the chair from the linkage on one side to the other so as to join the ottoman links 104 on each side of the chair. A bracket 304 is provided on each of the ottoman links 104 to connect the cross tube 302. At its approximate center, cross tube 302 carries a second bracket 306 having a flange 308 which may be rivetted, welded, or otherwise secured to the upper surface of the cross tube. The bracket 306 is shaped as an inverted V with the flange 308 formed at the lower end of the front arm 310. The lower end of rear arm 312 carries a pin 314 that forms part of the latching mechanism to restrain the chair section against reclining motion under the influence of the spring 300.

A second cross tube 316 shown in FIG. 10 may be connected to the mounting plate 50 and extend across the reclining chair section from one side to the other. The cross tube 316 remains stationary without regard to the motion of the chair between the upright, TV and reclining positions. A bracket 318 having a flange 320 is mounted on the side 322 of the cross tube 316 and in turn pivotally supports a latch 324 by means of rivet 326. The latch 324 has a forwardly extending finger 328 which carries a hook 330 that is positioned to engage the pin 314 carried by bracket 306 when the ottoman linkage 100 is retracted as shown in FIGS. 5 and 10. Latch 324 has a second finger 332 which extends upwardly from the pivot 326, and the free end of that finger is connected to an actuating cable 334. The cable 334 in turn may be connected to a push button control or similar device. This arrangement is shown in detail in copending application Ser. No. 07/638,442 filed Jan. 4, 1991 and assigned to the assignee of the present application. It will be appreciated that when the cable is drawn to the right as viewed in FIG. 10, the latch 324 will pivot clockwise about the pivot 326 so as to cause the hook 330 of the finger 328 to release the pin 314. That action will release the mechanism to the action of spring 300 so as to cause the pivot links 80 and 82 to move in a counter-clockwise direction and carry the center of gravity of the chair and its occupant over center in a well-understood fashion so that the occupant's weight will carry the mechanism to the TV position and the ottoman linkage 100 will extend to the position shown in FIG. 6.

Latch 324 has a third rearwardly extending finger 336 having a hole 338 at its rear end that is connected to one end of a coil spring 340. The other end of the coil spring 340 is connected to the rearwardly extending arm 342 of bracket 318. Spring 340 urges the latch 324 to pivot counter-clockwise as viewed in FIG. 10 so as to cause its hook 330 to engage the pin 314. It will be noted that the front end of hook 330 carries a ramp 344 which will guide the pin 314 into a position to be engaged by the hook 330 when the ottoman is retracted. The spring 340 will allow the latch 324 to pivot clockwise slightly under the lifting force applied to it by the pin 314, which will enable the pin to slide beneath the hook into the position shown in the drawing.

In accordance with the present invention, the arm panel 32 is secured to and moves with the seat frame 28 relative to the floor and base rails 24 when the seat moves from the upright to either of the reclined positions. The arm panel 32 is mounted to the seat by means of a pair of brackets 160 carried by the seat frame 28. The attachment may be made to the seat frame or the seat mounting plate to accommodate the particular styling of the chair section. It will be noted in FIG. 4 that an arm panel 32 is mounted on only one side of the chair section 22, namely, the side away from the sofa section 20. It will also be noted that the outside wing 34 is secured to the back frame 30 so that the wing moves with the backrest 42 as the chair moves between the upright and reclined positions. Again, the wing is confined to the side of the chair away from the sofa section 20, and no corresponding structure is provided on the side of the chair section adjacent the sofa. Rather, the center rail 35 shown in FIG. 4 and described above is provided and remains stationary during the operation of the chair.

Figure 15:
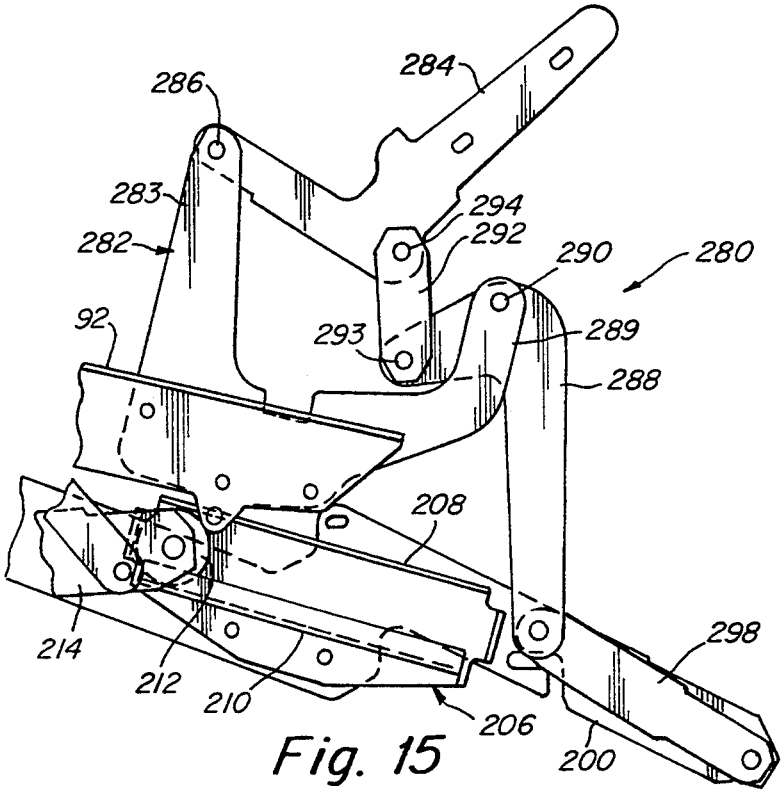
FIG. 15 is a detailed view similar to FIG. 14, but showing the backrest in the fully reclined position.
Figure 16:
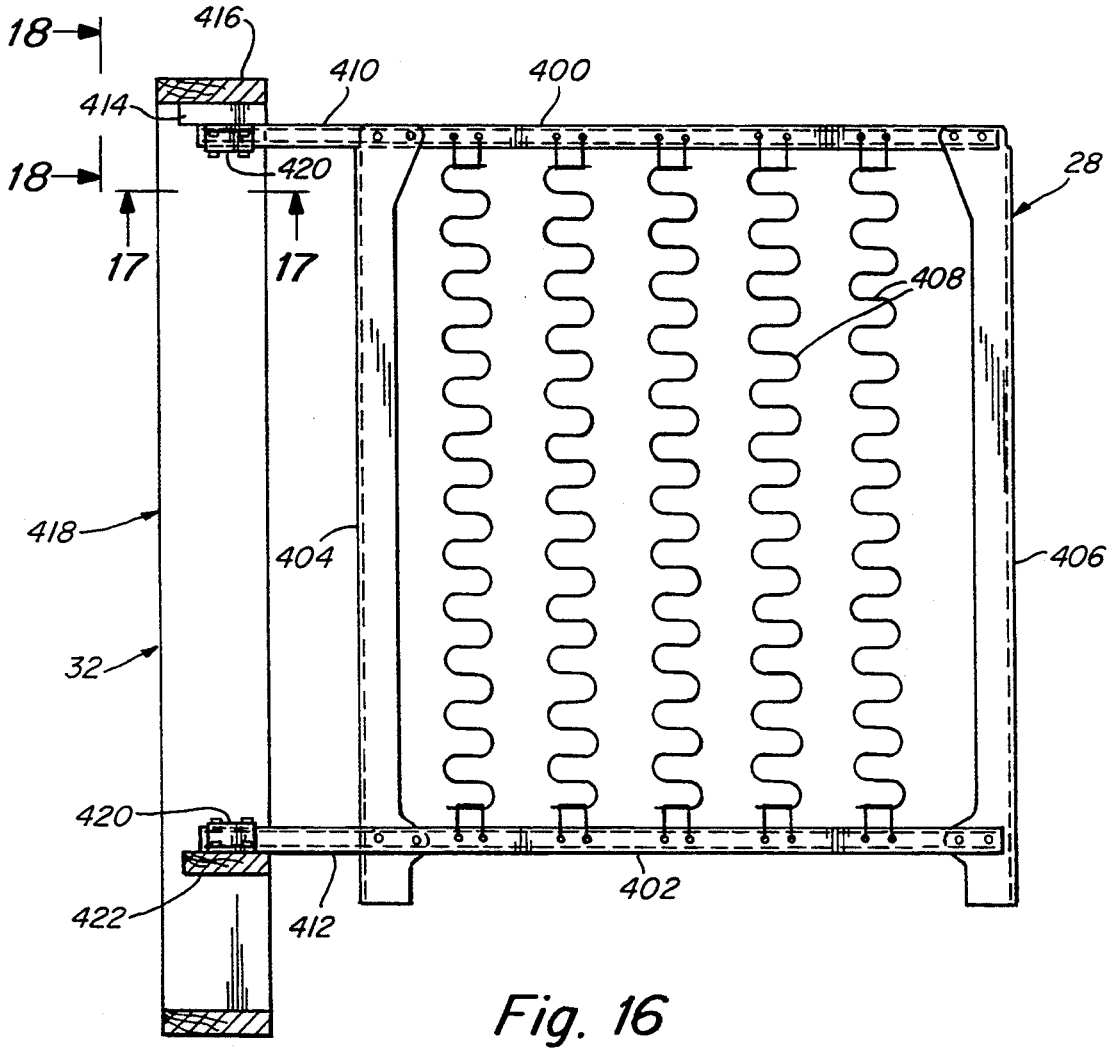
FIG. 16 is a plan view of the preferred seat frame and shows the manner in which the arm panel is carried by it.
Figure 17:
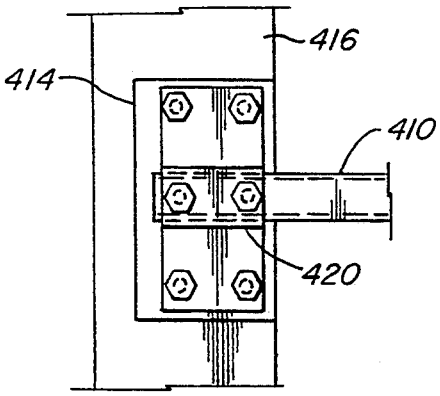
FIGS. 17 and 18 are detail views showing the connection of the frame and arm panel, taken along site lines 17—17 and 18—18 in FIG. 16.
Figure 18:
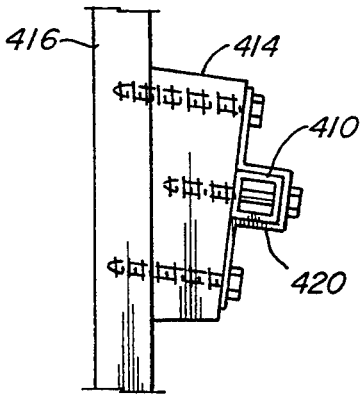

In FIGS. 16–19, a preferred means of mounting the arm panel to the seat frame is shown. This technique is applicable to both the embodiment of FIGS. 4–10 and to the embodiment of FIGS. 11–15 described below. In FIG. 16, the seat frame 28 includes front and rear square metal tubular members 400 and 402 and left and right side rails 404 and 406. Sinuous springs 408 extend between the front and rear tubular members 400 and 402 and provide the support for the seat cushion of the chair section. The side rails 404 and 406 may be mounted on and carried by the seat mounting links 92 of the mechanisms 36 or may be integral with and form part of the seat mounting links. In the embodiment shown, the side rails 404 and 406 are one and the same with the seat mounting link 92. Obviously, a metal seat frame as herein described has great strength and will be more resistant to bending or breaking than a conventional wood frame.

In FIG. 16, the front and rear tubular members 400 and 402 extend beyond the left side rail 404 of the frame, as shown at 410 and 412. Those extensions directly support the arm panel 32. A spacer block 414 is shown connected to the rear face of the front post 416 of the frame 418 of the arm panel 32, and a bracket 420 is bolted to the extension 410 and block 414. A similar arrangement is used to connect the rear extension 412 to the arm post 422.

Figure 19:
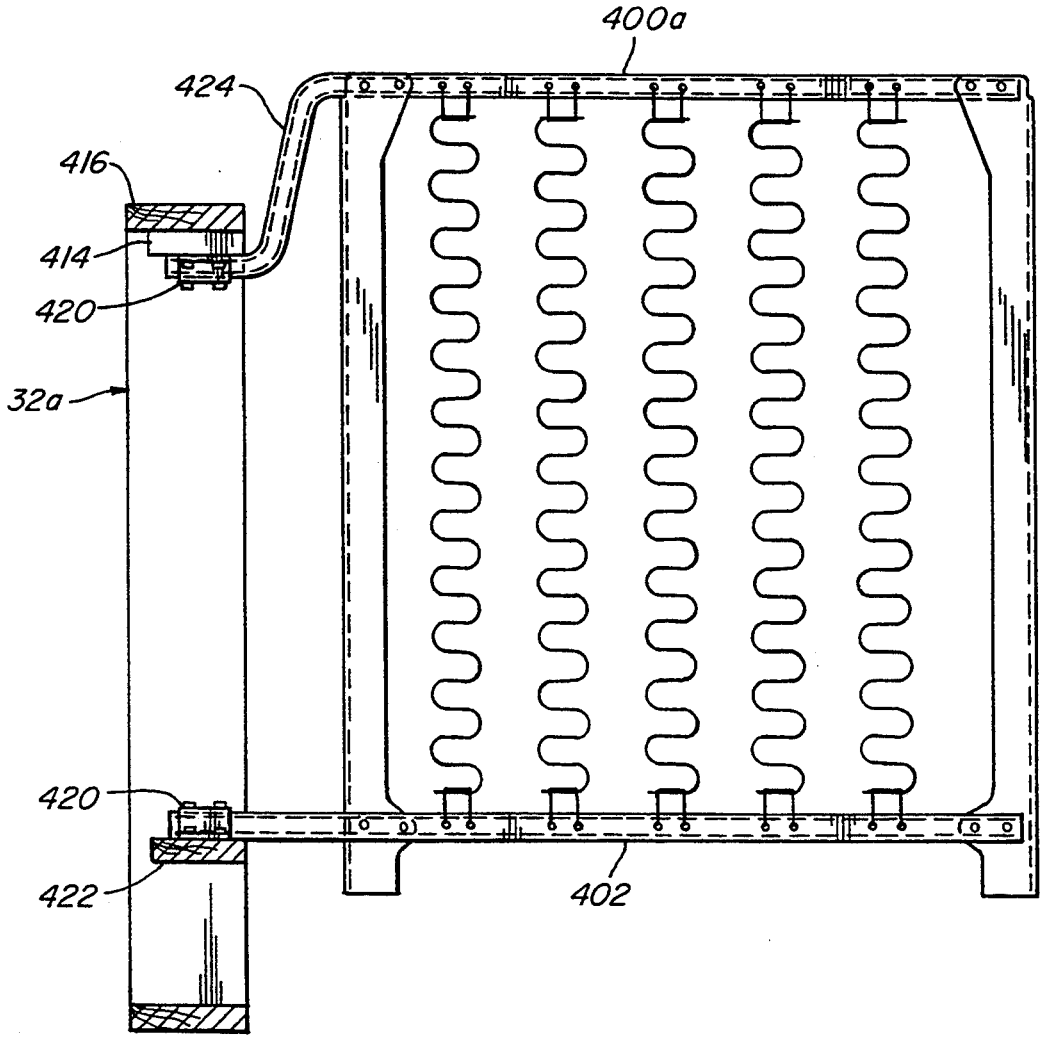
FIG. 19 is a plan view similar to FIG. 16 and showing an alternative seat frame designed for use with a T-cushion seat.

In FIG. 19, an alternative seat frame construction is shown intended for use with a T-cushion design. In this embodiment, the front tube **400*a* has a bend 424 that extends forwardly of the vertical transverse plane of the front post 416 of the arm so that the seat frame may support the T-cushion extension of the seat in front of the arm panel 32**.

In each form of construction shown in FIGS. 16 and 19, considerable savings may be realized by the reduced number of parts, the dual function of the seat frame both as part of the mechanisms and the spring support, and the deminished number of parts in the assembly of the chair section.

The operation of the chair section shown in FIGS. 4–10 is as follows: An occupant of the chair section wishing to move the section to a TV or fully-reclined position will, through a pushbutton or other similar control (not shown) draw the control cable 334 so as to cause the latch 324 to release the pin 314. When the pin is disengaged, the mechanisms on each side of the chair are released to the action of spring 300 which will cause the pivot links 80 and 82 to move in a counter-clockwise direction and carry the seat mounting link 92 in a forward direction with respect to the base rails 24. That action will cause the ottoman control link 122 to pull on the extension 125 of ottoman link 104 and extend the lazy tong linkage to the position of FIG. 6. During this action, the backrest 42 remains fixed with respect to the seat 40, that is, the angle between the two remains the same. The two together, however, move generally in a forward direction. To move to the fully reclined position, the occupant need merely apply pressure in a rearward direction against the backrest which, through the mechanism described above and shown in FIGS. 8 and 9, will cause the swing links to move in a clockwise direction so as to carry the support link 66 in a forwardly direction and as a result, carry the four-bar linkage comprising the seat mounting link, pivot links and support link to the position of FIG. 7.

In the embodiment of this invention shown in FIGS. 11–15, the chair frame structure is identical to that shown and described in connection with the first embodiment. However, the mechanism for assembling the seat and backrest along with the arm panel and back wing is different. The mechanism is similar to that shown in my copending application Ser. No. 07/333,590 filed Apr. 4, 1989 and entitled "THREE-WAY INCLINER" which, in turn, is a continuation of application Ser. No. 07/060,099 filed Jun. 9, 1987. Those applications have a common assignee with the present application. This mechanism includes a base plate 200 which is secured to the inside face 52 of the base rail 24 by means of screws, rivets or other fasteners 202. The mounting plate 200 carries front and rear tracks 204 and 206 which include upper and lower flanges 208 and 210 that retain rollers 212 that move within the tracks. These rollers are mounted on the front and rear ends, respectively, of a roller link 214. The roller link 214 forms the main support for the frame.

Roller link 214 carries upwardly extending front and back pivot links 240 and 242 connected to the roller link by rivets 244 and 246, respectively, and the upper ends of the pivot links are connected by rivets 248 and 250 to the seat mounting link 92. The roller link 214, pivot links 240 and 242 and seat mounting link 92 define a four-bar linkage which moves the seat 40 between the upright and TV positions of FIGS. 11 and 12. When moving from the upright to the TV position, the seat mounting link 92 moves forwardly and slightly downwardly with respect to the base rails 24.

A lazy tong linkage 256, which is essentially the same as the lazy tong linkage 100 of the first embodiment, supports the ottoman bracket 254 that carries the ottoman 38. Because the lazy tong linkage is essentially the same as the mechanism of the first embodiment, it does not require a detailed description. The lazy tong linkage 256 is pivoted to the seat mounting link 92 by pivot rivets 255 and 257 which join the ottoman links 259 and 261, respectively to the seat mounting link. One end of drive link 266 is connected to the end of the ottoman link 261 beyond the pivot 257, and the other end of the drive link is connected by means of rivet 268 to the roller link 214. Consequently, when the seat link 92 moves forwardly on the pivot links 240 and 242 with respect to the roller link 214, the drive link 266 pulls the upper end of the ottoman link 261 in a rearward direction relative to the seat link causing link 261 to rotate clockwise on its pivot 257. That action, in turn, causes the entire lazy tong linkage 256 to extend to the position shown in FIG. 12 and elevate the ottoman 38.

Figure 14:
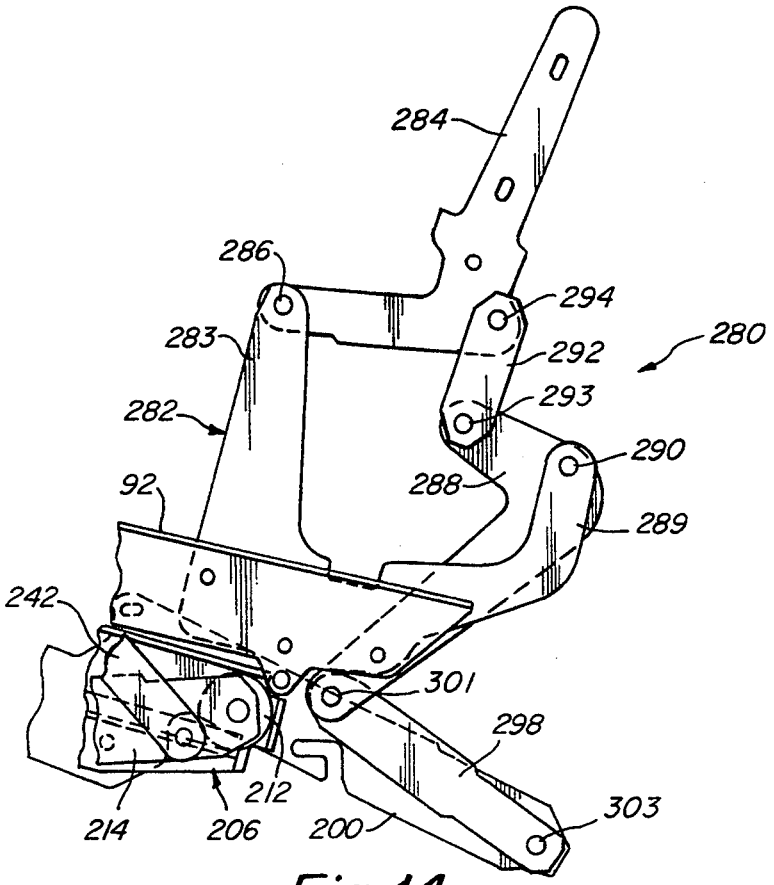
FIG. 14 is a detailed view of the backrest mounting linkage in the mechanism of FIGS. 11–13 with the backrest in the TV position.

The backrest mounting linkage 280 shown in FIGS. 14 and 15 supports the backrest frame 30 on the seat mounting link 92. That linkage 280 includes a rear bracket 282 mounted on and fixed with respect to the seat mounting link 92. Bracket 282 has front and rear arms 283 and 289 that extend upwardly from the seat mounting bracket 92. The front arm 282 of rear bracket 282 pivotally supports back mounting link 284 by means of rivet 286. A back drive crank 288 is pivoted intermediate its ends on the rear arm 289 of bracket 282 by means of rivet 290. The drive crank 288 is pivoted at one end by rivet 293 to short link 292 which is also pivotally connected to the back mounting link 284 by rivet 294. The other end of drive crank 288 is pivotally connected to back drive connector link 298 by a rivet 300. The connector link 298 is, in turn, connected by rivet 302 to the base rail 24.

Figure 12:
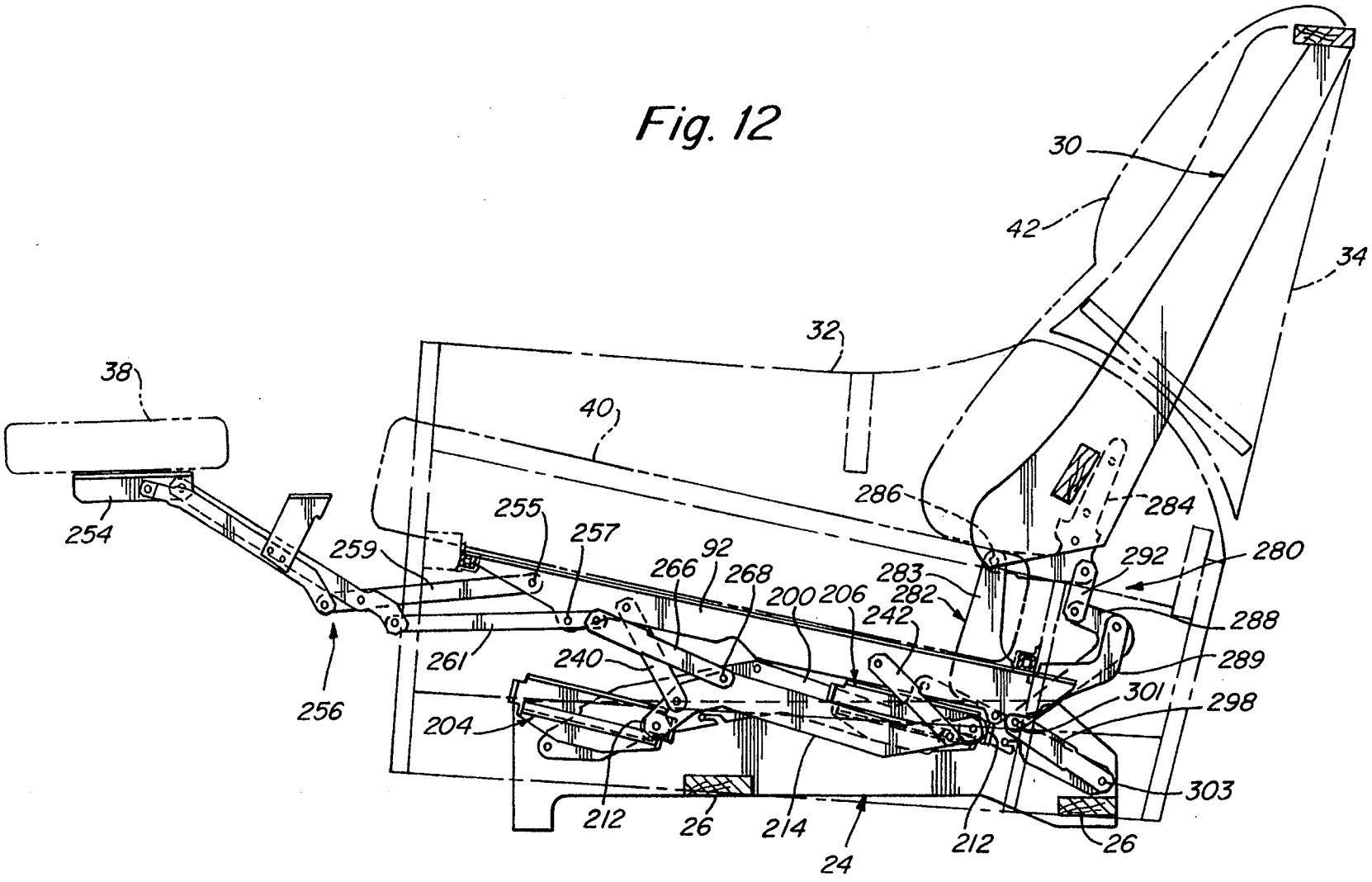
FIG. 12 is a view similar to FIG. 11, but showing the modular chair section in the TV position.

Rear bracket 282, back drive link 288, short link 292 and back mounting link 284 together define a four-bar linkage which enables the backrest to pivot rearwardly with respect to the seat. This action occurs when the chair moves from the TV position of FIG. 12 to the fully reclined position of FIG. 13. When the chair occupant pushes against the backrest 42, the back mounting link 284 pivots clockwise as viewed in FIG. 12 about its pivot 286, which drives the short link 292 downwardly and causes the back drive crank 288 to turn counterclockwise on its pivot 290 on the bracket 282. That action causes the drive crank 288 to push against the fixed base rail through the back drive connector link 298 and forces seat mounting link 92, pivot links 240 and 242 and roller link 214 to move forwardly and upwardly on the tracks 204 and 206. (Compare FIGS. 12 and 13. In FIG. 12 the rollers 212 are positioned at the rear ends of the tracks 204 and 206, and in FIG. 13, the rollers are at the front ends thereof.) Consequently, the seat moves forwardly and upwardly with respect to the fixed base rails. Flanges are provided on the ends of the tracks and serve as safety stops for the rollers and the roller link.

Figure 13:
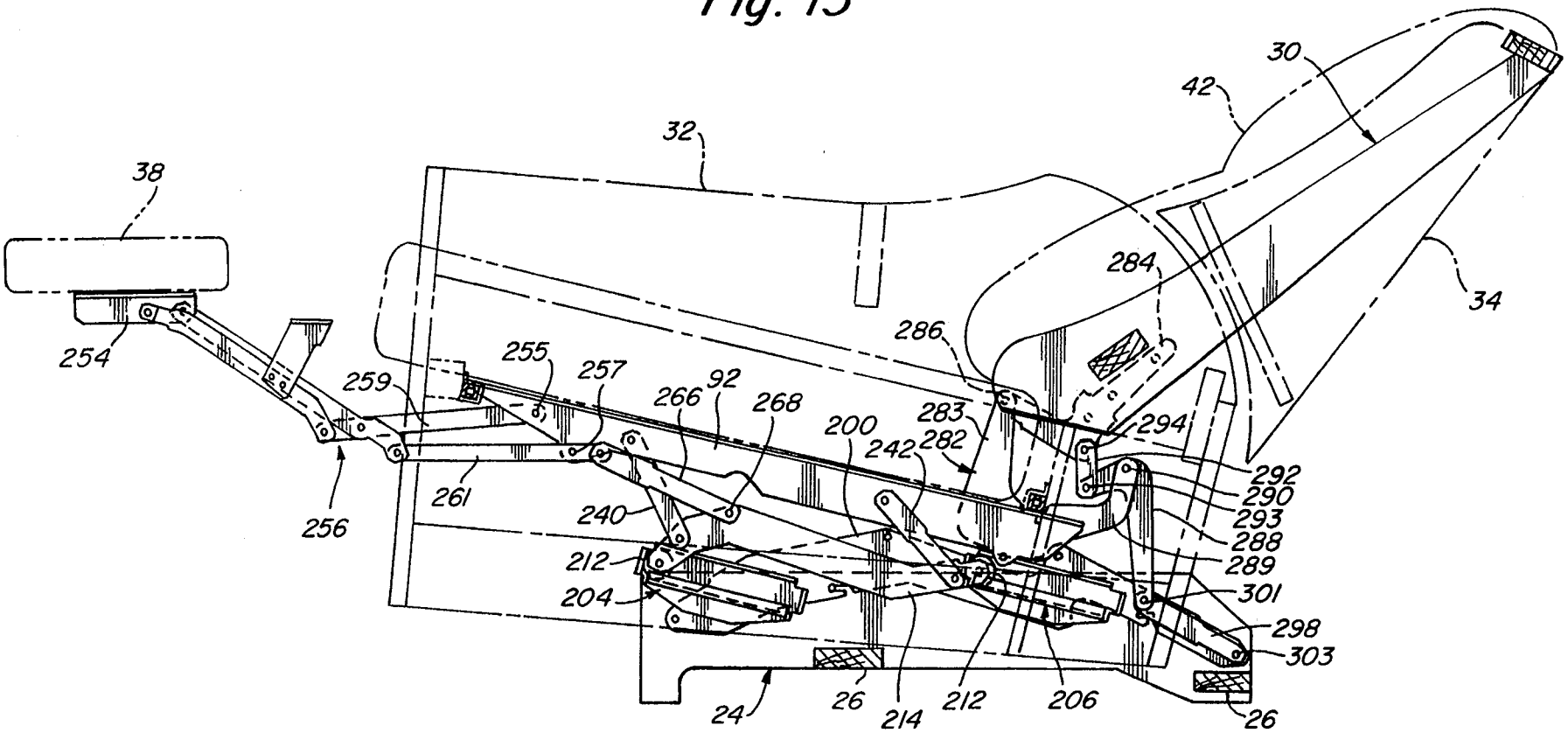
FIG. 13 is a view of the chair section similar to FIGS. 11 and 12, but showing the chair section in the fully reclined position.

As in the first embodiment, the arm panel 32 is secured to brackets 160 connected to the seat frame 28 so that the arm panel lies outside the base rail on its side of the chair. Similarly, the outside back wing 34 is secured to the back frame 30 on the same side of the chair as the arm panel 32. The other side of the chair includes neither the arm panel nor the wing, but rather may be provided simply with a center rail in the plane of the base rail 24 to abut against the adjacent end of the sofa section 20. Also as in the first embodiment, the mechanism may be spring loaded by a spring that extends between the rear of the seat mounting link 92 and the roller link 214, and a latching device like that shown in FIG. 10 may be used to restrain forward movement of the seat mounting link and ottoman unless actuated by the cable connected to a push button (not shown) or other control mounted on an accessible location of the chair. The operation of the chair of this embodiment is initiated by the chair occupant pressing the button to release the latch and free the mechanism to the influence of the spring. The spring will move the pivot links 240 and 242 over center and enable the occupant's weight to further drive the chair to the TV position. This same action causes elevation of the footrest by the drive link 266 as described fully below. Further reclining motion of the chair to the fully reclined position of FIG. 13 is achieved by the application of pressure against the backrest by the occupant. The backrest linkage shown in FIGS. 14 and 15 will cause the roller link, pivot links and seat mounting link which comprise the four-bar linkage to move as a unit on the tracks 210.

Having described this invention in detail, those skilled in the art will appreciate the numerous modifications which can be made thereof. For example, while a push button controlled latching device is shown to retain the chair in the upright position, a handle control as is commonly used in the prior art may be employed. Other similar modifications may be employed as well. Therefore, it is not intended that the scope of this invention be limited to the specific embodiments illustrated and described. Rather, the scope of the invention is to be determined by the appended claims and their equivalents.

We claim:

1. A modular furniture seating section having a reclining seat and backrest incorporated therein with one side of said seating section intended to be positioned at one end of a grouping of modular furniture sections comprising:

a pair of stationary side base rails disposed on the floor and having inside faces disposed opposite one another, a pair of reclining mechanisms each having a mounting plate mounted by fastening means on the inside face of one of the separate side base rails, each of said mechanisms also having a seat mounting link dispose above the fastening means, a metal seat frame for the reclining seat having sides secured to each of the seat mounting links enabling the seat to move with respect to the base rails from an upright position to intermediate and fully reclined positions, said metal seat frame having front and rear cross tubes with ends that extend outwardly beyond the seat mounting link and the side base rail on the side of the seat to be positioned at the end of the grouping of furniture sections, ottoman linkages forming part of each mechanism and an ottoman carried by the ottoman linkages for movement between a retracted position beneath the seat when the seat is in the upright position and an extended position when the seat is in the intermediate and fully reclined positions, a backrest linkage forming part of each mechanism, and a backrest frame for the backrest having sides connected to each of the backrest linkages for moving the backrest frame and seat in fixed relationship to one another when the seat moves between upright and intermediate positions and for moving the backrest frame relative to the seat when the seat moves between intermediate and fully reclined positions, an arm panel secured to the ends of the cross tubes only on the side of the seat to be positioned at the end of the grouping of furniture sections and disposed outside the base rail on that side of the seat, said arm panel moving with and being in a fixed position relative to the seat, and a backrest side wing secured to the side of the backrest frame on the same side of the section as the arm panel and defining the outside end of the backrest of said seating section.

2. A modular furniture seating section having a reclining seat and backrest incorporated therein with one side of said seating section intended to be positioned at one end of a grouping of modular furniture sections comprising a pair of stationary wood side base rails disposed on the floor and having inside faces disposed opposite one another, a pair of reclining mechanisms each having a seat mounting link and mounted on the inside faces of each of the side base rails, a seat frame for the reclining seat having sides secured to each of the seat mounting links enabling the seat to move with respect to the base rails from an upright position to intermediate and fully reclined positions, said seat frame having front and rear metal cross members with ends that extend outwardly beyond the seat mounting link and the side base rail on the side of the seat to be positioned at the end of the grouping sections, a backrest linkage forming part of each mechanism, a backrest frame for the backrest having sides connected to each of the backrest linkages for moving the backrest frame and seat in fixed relationship to one another when the seat moves between upright and intermediate positions and for moving the backrest frame relative to the seat when the seat moves between intermediate and fully reclined positions, an arm panel secured to the ends of the metal cross members on the side of the seat to be positioned at the end of the grouping of furniture sections and disposed outside the base rail on that side of the seat, said arm panel moving with and being in a fixed position relative to the seat, and a backrest side wing secured to the side of the backrest frame on the same side of the section as the arm panel and defining the outside end of the backrest of the seating section.

3. A modular furniture seating section having a reclining seat and backrest incorporated therein comprising a base, a pair of reclining mechanisms each mounted on the side of the base, each of said mechanisms having a seat mounting link, a metal seat frame for the reclining seat secured to each of the seat mounting links enabling the seat to move with respect to the base from an upright position to a reclined position, said seat frame having front and rear metal cross members with ends that extend outwardly beyond the seat mounting link on one side of the seat frame and having springs that extend between and are secured to the cross members, ottoman linkages mounted adjacent the front of the seat and an ottoman carried by the ottoman linkages for movement between a retracted position beneath the seat when the seat is in the upright position and an extended position when the seat is in the reclined position, a backrest linkage forming part of each mechanism, and a backrest frame for the backrest connected to the backrest linkage for moving the backrest when the seat moves between the upright and fully reclined positions, an arm panel secured to said ends of the cross members on one side only of the seat and outside the base on that side of the seat, and a backrest side wing secured only to the same side of the backrest frame as the arm panel and disposed in a plane parallel to the arm panel.

4. A modular furniture seating section having a reclining seat and backrest incorporated therein with one side of said seating section intended to be positioned at one end of a grouping of modular furniture sections comprising a base, a pair of reclining mechanisms mounted on each of the opposite sides of the base, each of said mechanisms having a seat mounting link, a metal seat frame for the reclining seat secured to each of the seat mounting links enabling the seat to move with respect to the base from an upright position to a reclined position, a backrest linkage forming part of each mechanism, and a backrest frame for the backrest connected to the backrest linkage for moving the backrest relative to the seat when the seat moves between the upright and fully reclined positions, said seat frame having front and rear metal cross members with ends on the side of the seat intended to be positioned at the nd of the modular sections that extend outwardly beyond the seat mounting link and having springs that extend between and are secured to the cross members, an arm panel secured to said ends of the cross member on the side of the seat intended to be positioned at the end of the modular sections and outside the base on that side of the seat, and a backrest side wing secured to the side of the backrest frame on the same side as the arm panel and disposed in a plane parallel to the arm panel.

5. In modular furniture having a reclining seat section with fixed base rails for supporting the seat section on the floor, a seat frame and a backrest frame movable with respect to the base rails, and an armrest panel and a back wing panel on one side only of the seat section and movable, respectively, with the seat frame and backrest, a pair of reclining mechanisms for the section each comprising a mounting plate separate from the base rail and secured to a base rail, a linkage assembly connected to the mounting plate for moving the seat frame, back frame, and arm panel and back wing panel as a unit forwardly and downwardly with respect to the base rails to an intermediate reclining position, and means connecting the linkage assembly to the mounting plate responsive to pressure exerted against the backrest for simultaneously moving the backrest and back wing panel rearwardly and downwardly with respect to the seat and the seat forwardly and upwardly with respect to the base rail to a fully reclined position.

6. In modular furniture as defined in claim 9, said means connecting the linkage assembly to the mounting plate including a support link carried by the mounting plate and in turn carrying the linkage assembly.

7. In modular furniture as defined in claim 10, said means connecting the linkage assembly to the mounting plate further including a pair of swing links for swingably supporting the support link on the mounting plate.

8. In modular furniture as defined in claim 6, said linkage assembly comprising a four-bar linkage including the mounting plate.

9. In modular furniture as defined in claim 8, said four-bar linkage including a pair of pivot links connected to the support link and the seat frame.

10. In modular furniture as defined in claim 9, said means connecting the linkage assembly to the mounting plate including a track assembly connected to the mounting plate and a roller link movable on the track assembly and carrying the linkage assembly.

11. In modular furniture as defined in claim 10, said assembly linkage including a pair of pivot links connected to the roller link and the seat frame.

12. In modular furniture as defined in claim 9, said linkage assembly comprising a four-bar linkage including the mounting plate.

13. In modular furniture as defined in claim 9, an ottoman linkage connected to the mechanism and movable between retracted and extended positions, and means extending the ottoman mechanism as the linkage assembly moves the seat frame to the intermediate position.

14. A modular seating section as defined in claim 17 wherein the seat frame sides are integral with the seat mounting links.

15. A modular seating section as defined in claim 18 wherein the seat frame includes front and rear tubular members connected to the seat frame sides, said tubular members having ends extending outwardly beyond the seat on the side of the seating section at the end of the grouping, and fastening means securing the arm panel to the ends of the tubular members extending beyond the seat.

16. A modular seating section as defined in claim 19 wherein springs extend between and are secured to the tubular members for supporting the seat.

17. Upholstered motion furniture seating having a reclining seat and backrest incorporated therein comprising a base having sides, a pair of reclining mechanisms, one mounted on each of the sides of the base, each of said mechanisms having a seat mounting link, a metal seat frame for the reclining seat secured to each of the seat mounting links enabling the seat to move with respect to the base from an upright position to a reclined position, said metal seat frame having front and rear cross members that on at least one side of the frame have ends that extend outwardly beyond the seat mounting link and side of the base on that side of the frame, ottoman linkages mounted adjacent to the front of the seat and an ottoman carried by the ottoman linkages for movement between a retracted position beneath the seat when the seat is in the upright position and an extended position when the seat is in the reclined position, a backrest linkage forming part of each mechanism, and a backrest frame for the backrest connected to the backrest linkage for moving the backrest when the seat moves between the upright and fully reclined positions, an arm panel secured to the ends of front and rear cross members outside the side of the base, and a backrest side wing secured to the same side of the backrest frame as the arm panel and disposed in a plane parallel to the arm panel.

* * * * *